United States Patent [19]

Johns

[11] 4,013,320

[45] Mar. 22, 1977

[54] HOOK PLOUGH APPARATUS FOR LONGWALL MINING

[75] Inventor: Robert W. Johns, Calgary, Canada

[73] Assignee: World Oil Mining Ltd., Calgary, Canada

[22] Filed: Oct. 31, 1975

[21] Appl. No.: 627,763

Related U.S. Application Data

[63] Continuation-in-part of Ser. No. 509,489, Sept. 26, 1974, Pat. No. 3,958,830.

[52] U.S. Cl. ..... 299/33; 299/11; 299/34; 299/80

[51] Int. Cl.[2] ..... E21C 27/35; E21D 15/02

[58] Field of Search ..... 299/11, 32–34, 299/80

[56] References Cited

UNITED STATES PATENTS

| | | | |
|---|---|---|---|
| 3,310,346 | 3/1967 | Heyer | 299/34 |
| 3,361,479 | 1/1968 | Lobbe | 299/34 |
| 3,861,749 | 1/1975 | Georg | 299/32 |

FOREIGN PATENTS OR APPLICATIONS

| | | | |
|---|---|---|---|
| 99,024 | 8/1961 | Netherlands | 299/33 |
| 6,600,653 | 7/1966 | Netherlands | 299/34 |

*Primary Examiner*—Ernest R. Purser
*Attorney, Agent, or Firm*—McLaws & Company

[57] ABSTRACT

A hook plow apparatus for use in longwall mining and particularly adapted for use in conjunction with a fixed arch shield mining system having rails mounted along the length of the shield. The apparatus includes a power transmission frame mounted for movement along the rails, a plow mounting body connected to the frame, upper and lower vertically extendable ranging plow blocks mounted on the plow mounting body and having plow blades thereon, means for propelling the frame, the mounting body and the ranging plow blocks along the rails, and means for extending the mounting body and the ranging plow blocks vertically and laterally toward the mine wall relative to the to the power transmission frame.

21 Claims, 14 Drawing Figures

Fig.10
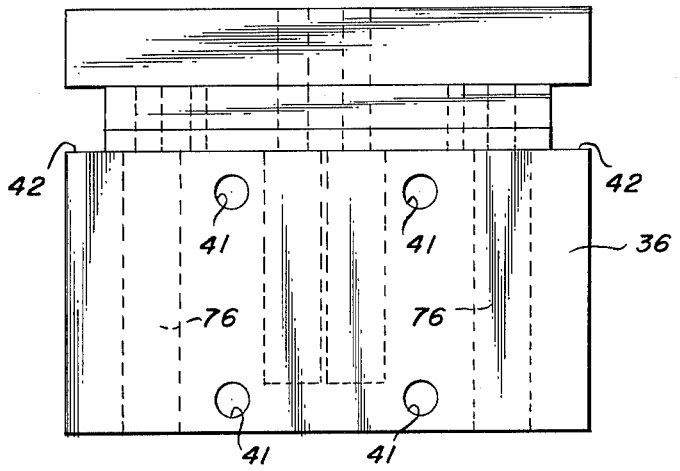
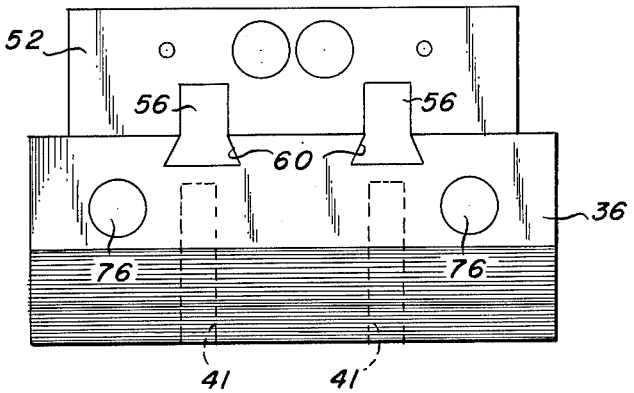
Fig.11
Fig.12
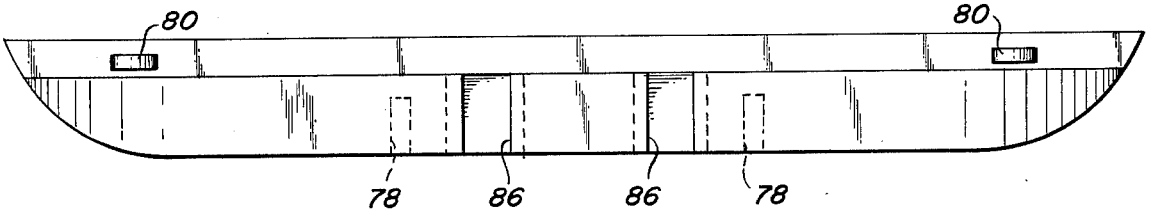
Fig.13
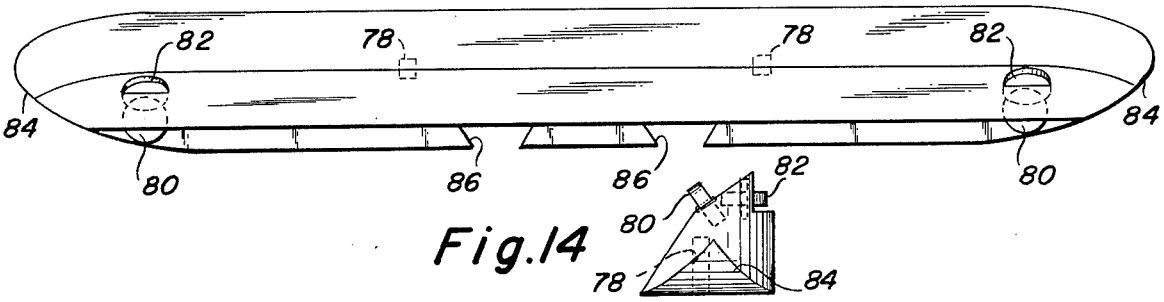
Fig.14

HOOK PLOUGH APPARATUS FOR LONGWALL MINING

CROSS-REFERENCE TO RELATED APPLICATIONS

This application is a continuation-in-part of my copending application Ser. No. 509,489 filed Sept. 26, 1974 and entitled "Apparatus and Method for Mining Tar Sands, Oil Shales, and Other Minerals", now U.S. Pat. No. 3,958,830.

This application is also related to my copending application Ser. No. 549,823 filed Feb. 13, 1975 and entitled "Mining Machine Propulsion Motor" now U.S. Pat. No. 3,954,300.

This application is also related to U.S. Pat. No. 3,888,543 issued June 10, 1975 and entitled "Method for Mining Oil Shales, Tar Sands and Other Minerals".

The specifications of U.S. Pat. Nos. 3,888,543, 3,958,830 and 3,954,300 are incorporated herein by reference.

BACKGROUND OF THE INVENTION

This invention relates to a hook plow mining apparatus. More specifically, this invention relates to a hook plow mining machine especially adapted for use in conjunction with the fixed arch shield mining technology described in application Ser. No. 509,489. This technique is particularly useful in the mining of oil sands, but is also capable of use for coal mining, mining of oil shale, and mining other minerals capable of being mined by longwall techniques. The mined material, after being cut from the mining face, falls onto a longitudinal conveyor operating within the mining shield, and is then conveyed from the mining face to suitable collecting means operating at the ends of the face for ultimate conveyance through a shaft to the ground surface.

The mining shield comprises a plurality of individual arch sections in side-by-side abutting relationship, each arch section being advanceable towards the mining wall as the mining wall recedes, thereby creating a void posteriorly of the mining shield, leaving the back unsupported and free to gradually collapse behind the shield. The cutting equipment is normally not manned, the equipment travelling between a pair of operators stationed at the ends of the movable shield.

This technique combines the best features of longwall mining as used for mining coal, and block caving as used for mining metal ores. Further, some of the undesirable features of these prior art techniques have been eliminated. One such feature is the high cost of maintaining hydraulic roof support systems. Another problem with longwall coal mining which has been alleviated by the fixed arch shield technique is the necessity of using long, heavy chains stretched the full length of the longwall face for the transmission of power to propel the mining machines along the mine face. The amount of power which can be transmitted by such chains is of course dependent upon the strength of the weakest link in the chain, and is also decreased by wear. The power transmission system preferably used in the fixed arch shield technique is disclosed in application Ser. No. 549,823.

Although the fixed arch shield technique may use such mining machines as armored face conveyors, shearers, and plows, various degrees of modification are necessary so as to adapt these machines to operate within the shield. The present invention relates to plows for use in conjunction with this type of shield.

The modifications which are necesary include retractability of the plows so that the apparatus may be transported within the shield when not engaged in actual plowing, as well as expansibility so that the plow, when advanced forward out of the fixed arch shield so as to engage the mining face, can expand vertically and plow the mining face to the full height of the normal cut of the fixed arch shield.

OBJECTS OF THE INVENTION

Accordingly, a primary object of this invention is to provide a mining plow apparatus for use in a fixed arch shield.

Another object of this invention is to provide a mining plow which may be extended toward a mining face and retracted within the mining shield.

A further object of this invention is to provide a mining machine wherein the mining plows are vertically extensible.

Still another object of this invention is to provide a mining apparatus wherein the plow mounting bodies are rigidly braced with respect to the mining shield.

Still a further object of this invention is to provide a mining apparatus capable of travel along rails within the mining shield.

Yet a further object of this invention is to provide a mining apparatus wherein the power is transmitted to the cutting plows through a massive series of connections.

Yet a further object of this invention is to provide a travelling mining plow apparatus for use with a fixed arch shield which is capable of detecting and realigning any misaligned arch sections.

These and other objects and advantages of the present invention will become apparent when considered in light of the following description and claims when taken together with the accompanying drawings.

DESCRIPTION OF THE DRAWINGS

FIG. 10 is a rear elevation of the plow mounting body;

FIG. 11 is a top plan view of the plow mounting body;

FIG. 12 is a rear elevation of the upper guide member;

FIG. 13 is a top plan view of the upper guide member; and

FIG. 14 is an end elevation of the upper guide member.

DESCRIPTION OF THE INVENTION

Figure 1:
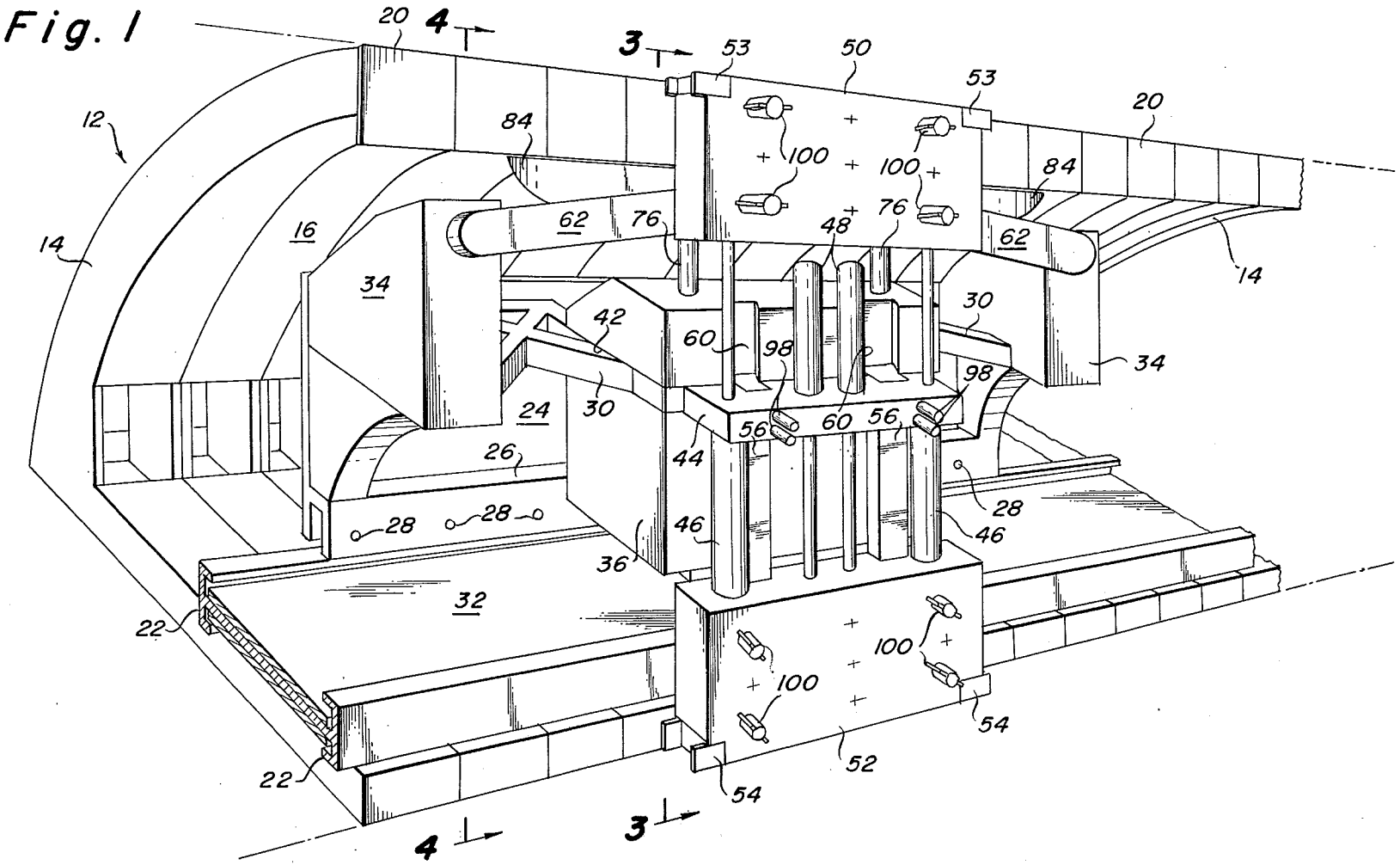
FIG. 1 is a perspective view of the apparatus of this invention with the mining plows in a fully extended position.
Figure 2:
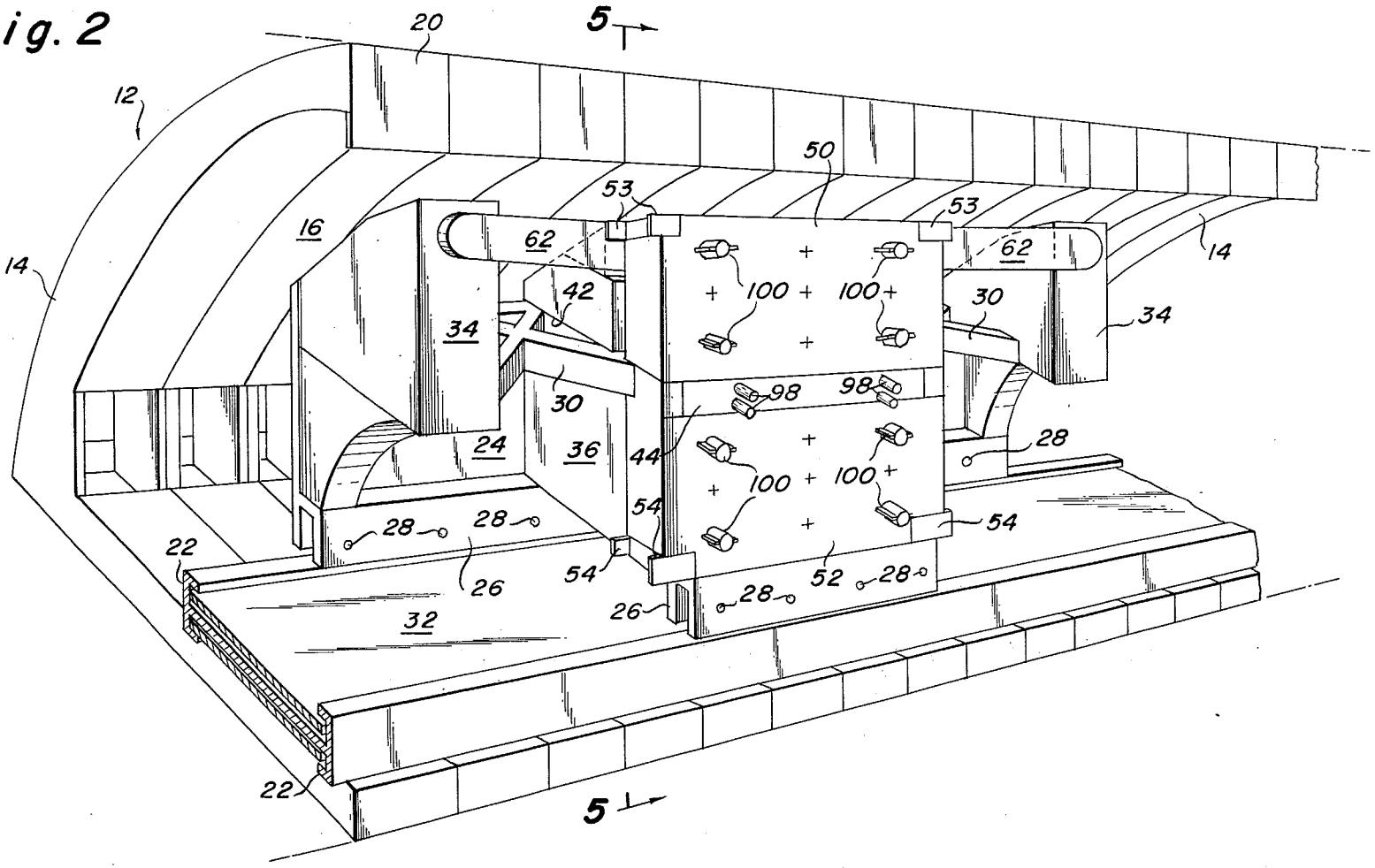
FIG. 2 is a perspective view similar to FIG. 1 showing the mining plows in the fully retracted position.

Referring first to FIG. 1, the mining machine generally designated 10 is seen to be mounted within the fixed arch shield generally designated 12. The shield is seen to comprise a plurality of arch sections 14 arranged in side-by-side abutting relationship so as to form a sidewall 16 and a bottom 18. The arch sections 14 are also provided at their distal ends with face plates 20 which are seen to depend slightly below the end of the wall surfce 16.

The bottom 18 is provided with a pair of rails 22 upon which the mining apparatus 10 is mounted.

The mining machine 10 is seen to include a power transmission frame 24 having a pair of inverted U-shaped channels 26. A plurality of wheels 27 are mounted upon axles 28 so that the wheels 27 support the frame 24 and the mining machine 10 upon the rails 22. The frame 24 is also seen to include a pair of trusses 30 of open construction so that any mined material excavated by the apparatus may fall through onto the conveyor 32 mounted therebeneath.

Figure 4:
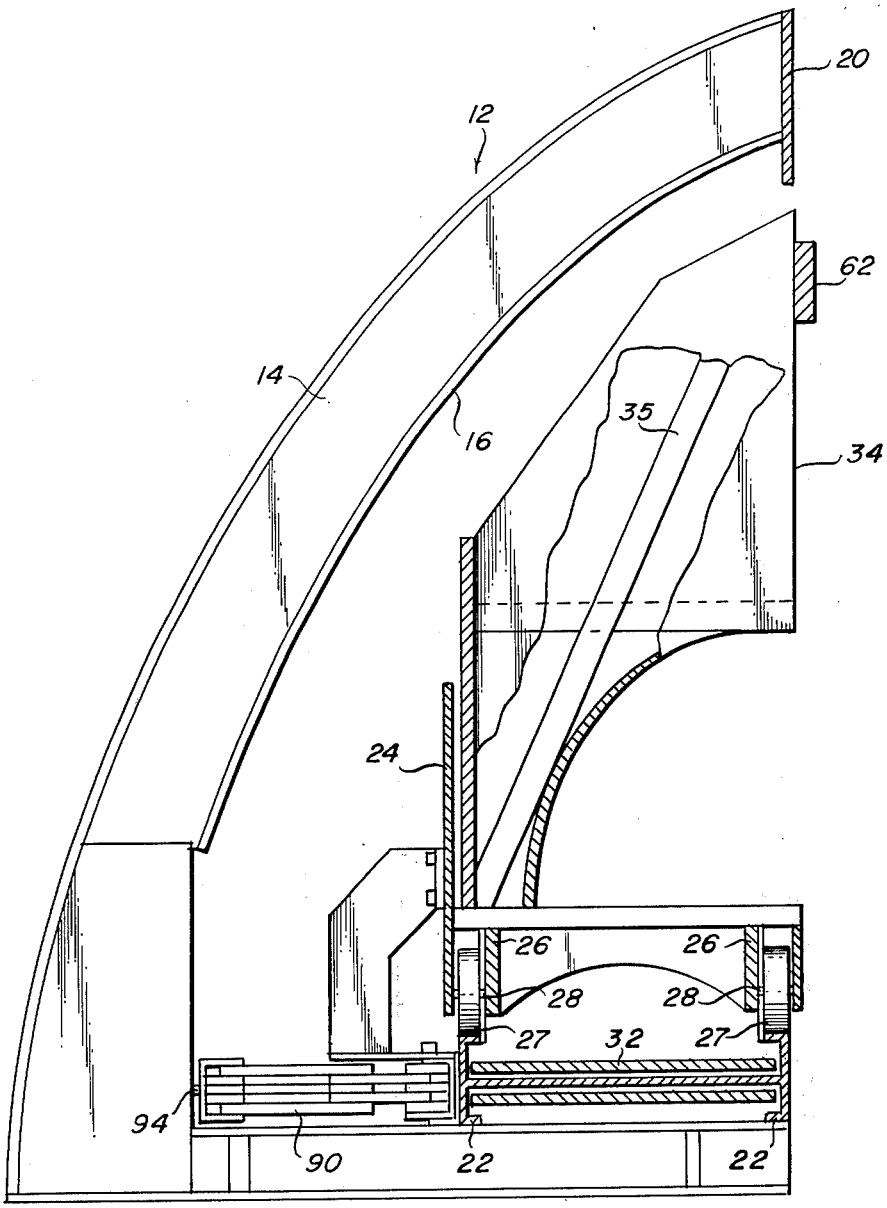
FIG. 4 is a sectional view along line 4—4 of FIG. 1, and viewed in the direction of the arrow and having a portion broken away for clarity.

The trusses 30 are connected to the support members 34 which are also attached to the frame 24, thus providing a rigid mounting assembly. With reference to FIG. 4, the support members 34 are seen to be provided internally with a bracing beam 35 for additional stability.

Figure 3:
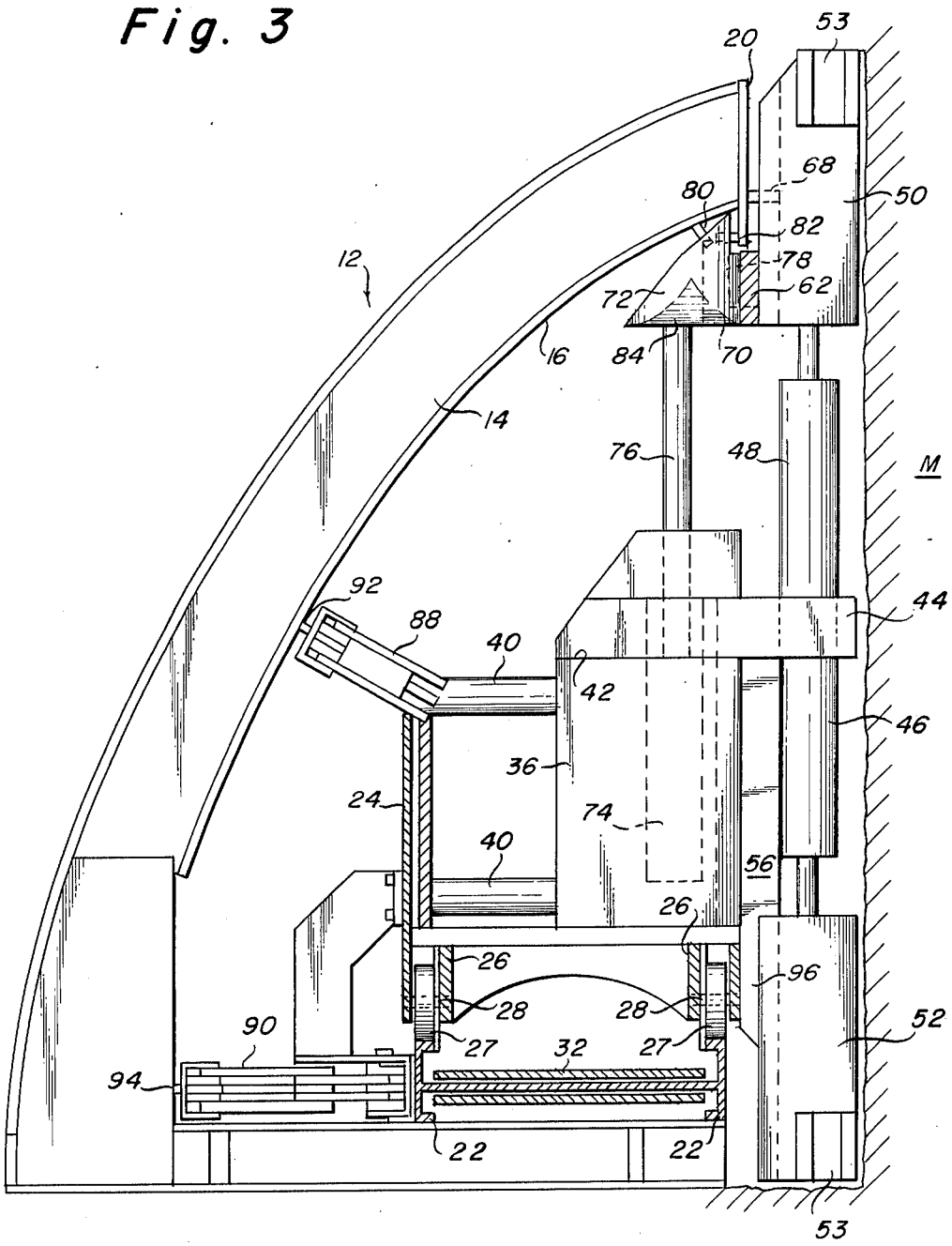
FIG. 3 is a sectional view along line 3—3 of FIG. 1, and viewed in the direction of the arrow.
Figure 5:
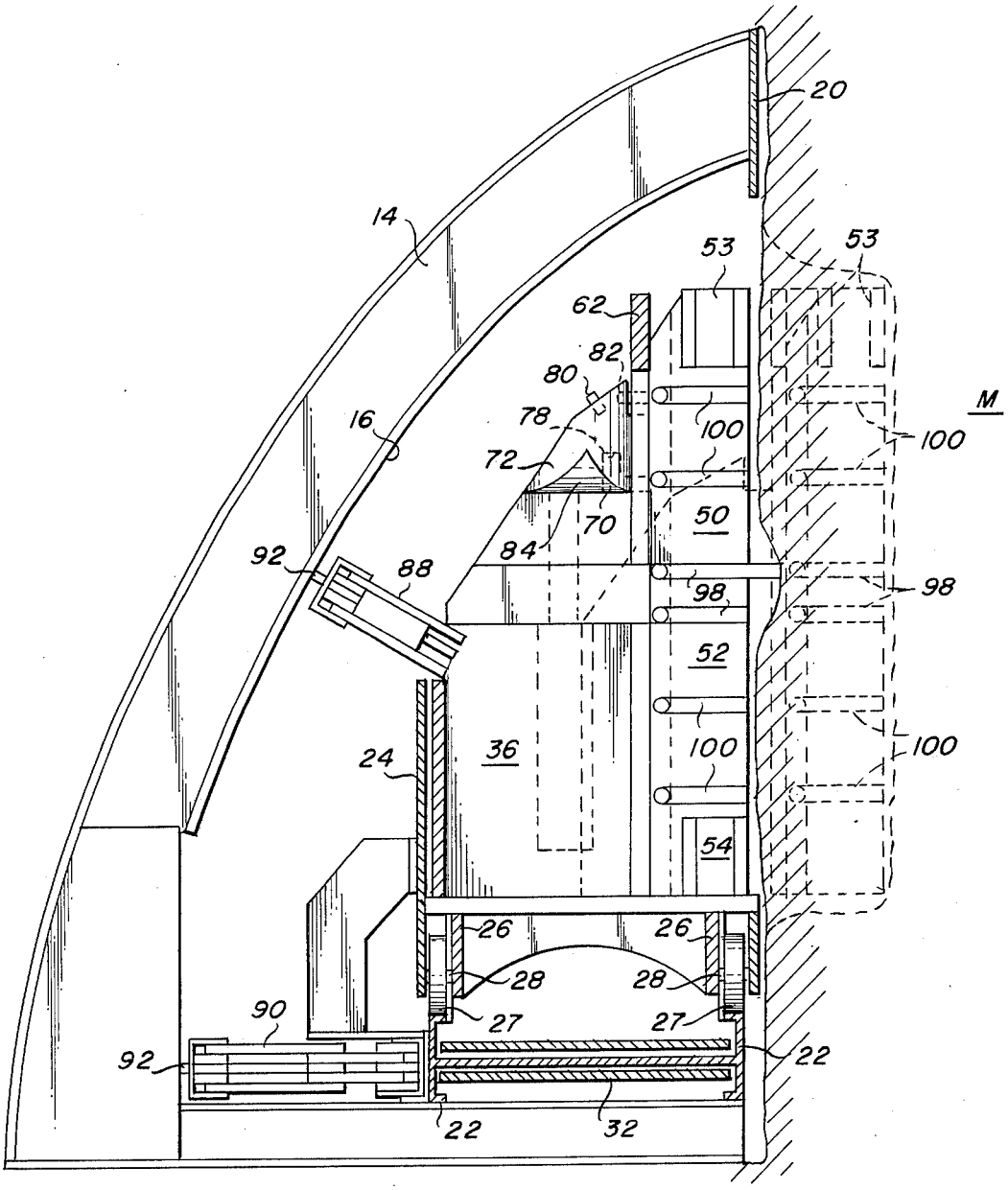
FIG. 5 is a sectional view along line 5—5 of FIG. 2, and viewed in the direction of the arrow.

The mining machine 10 is shown (in FIGS. 1–3, 10 and 11) to include a plow mounting body 36 mounted on base portion 38 of the frame 24. A set of doube acting hydraulic cylinders 40 are provided and connected between the frame 24 and the plow mounting body 36. The cylinders are accommodated in suitably sized wells 41 in the plow mounting body 36, and serve to extend and retract the plow mounting body and the plows towards the mine face M. This extension and retraction is best seen in FIGS. 3 and 5, and FIG. 5 particularly shows the mining machine in retracted position in solid line and in the extended position in dotted line. The plow mounting body 36 is provided with a pair of channels 42 so as to accommodate the relative movement between the trusses 30 and the plow mounting body 36. Thus, as the mounting body 36 travels back and forth, the trusses 30 slide in the channels 42.

The plow mounting body has an extension 44 projecting from the face thereof. Secured to the extension 44 are two pairs of hydraulic cylinders, 46 and 48. All four of the hydraulic cylinders are of the double acting type. In this manner, hydraulic cylinders 46 are used to raise and lower the upper ranging plow block 50, while the hydraulic cylinders 48 are used to raise and lower the lower ranging plow block 52. To accommodate the vertical motion of the ranging plow blocks 50 and 52, suitable wells (not shown) are provided adjacent the cylinders 46 and 48 in the blocks 52 and 50 respectively.

Figure 8:
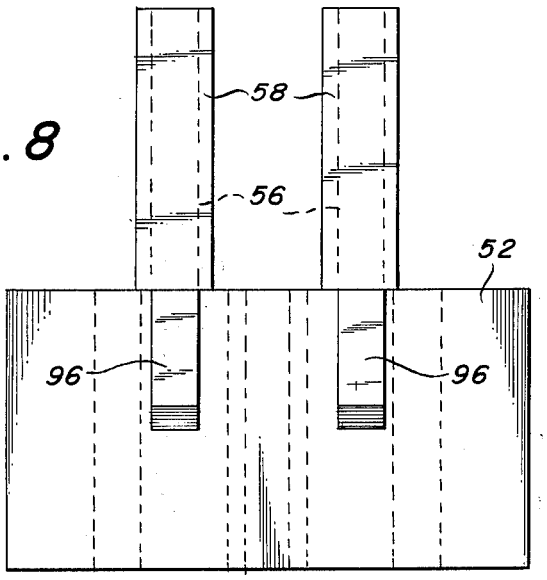
FIG. 8 is a rear elevation of the lower ranging plow block.
Figure 9:
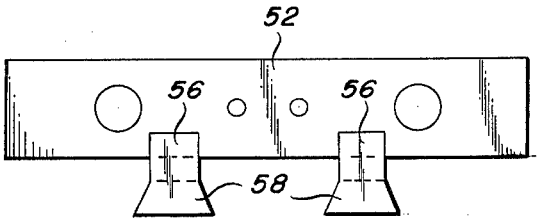
FIG. 9 is a top plan of the lower ranging plow block.

The lower ranging plow block 52 as seen in FIGS. 1, 8 and 9 is provided with a series of plow blades 54, while the upper ranging plow block is provided with a series of plow blades 53. These blades are of conventional design and thus are only shown schematically in FIG. 1.

The lower ranging plow block 52 is provided with a pair of upstanding support rods 56 having a cross-sectional configuration best seen in FIG. 9. The support rods 56 are provided with dove-tail shaped portions 58. The rods 56 are rigidly secured to the lower ranging plow block 52 and travel vertically therewith. The plow mounting body 36 is provided with complementary shaped dove-tail slots 60 in which the support rods slide during vertical movement. In this manner, the lower ranging plow block 52 is constrained against longitudinal and transverse movement relative to the plow mounting body 36, yet permitted to travel vertically.

The upper ranging plow block 50 is connected to the support members 34 by power transmission rods 62. The power transmission rods 62 are connected to the support members 34 by any suitable connection which will permit the necessary relative movement between the transmission rods and the support members.

Figure 6:
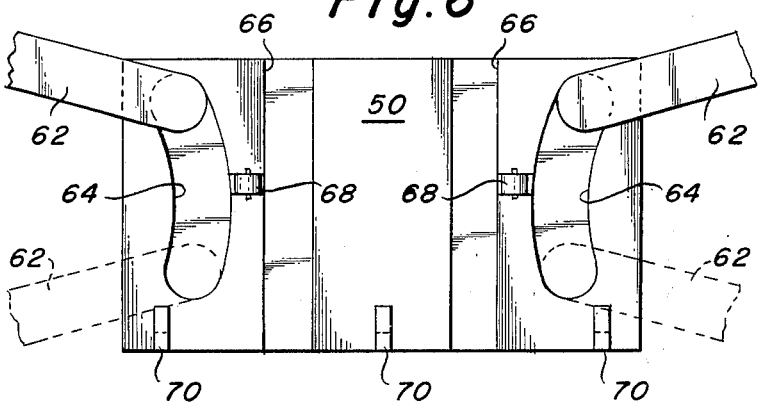
FIG. 6 is a rear elevation view of the upper ranging plow block.
Figure 7:
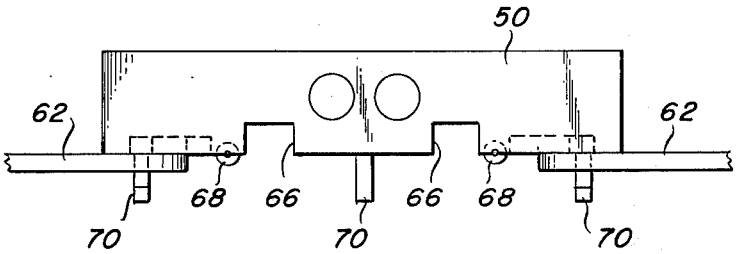
FIG. 7 is a top plan view of the element shown in FIG. 6.

The power transmission rods 62 are connected to the upper ranging plow block 50 in a manner best seen in FIG. 6. The rods 62 are provided with bosses (not shown) which are permitted to travel in arcuate slots 64 between the solid line position and the dotted line position as shown as the upper ranging plow block 50 moves from the fully extended position to the fully retracted position so that the boss is always in contact with the closest portion of the slots 64 absorbing any pull on the ranging plow block 50.

The upper ranging plow block 50 is also provided with channels 66 to provide a clearance for the support rods 56 as the upper and lower ranging blocks are retracted.

As seen in FIGS. 3 and 6, the upper ranging plow block 50 is provided with a pair of wheels or rollers 68. When the block 50 is in the fully extended position, the wheels 50 bear against the face plates 20 of the arches 14, so that any lateral thrust is transmitted to the arches 14. Additionally, the rollers 68 facilitate travel of the mining machine along the rails 22. The block 50 is also provided with a series of hook connectors 70, the purpose of these connectors will become apparent as the description proceeds.

In order to stabilize the plowing action of the upper ranging plow block 50, an upper guide member 72 is provided as seen in FIGS. 3 and 12–14. Guide member 72 is vertically extensible by means of hydraulic cylinders 74 mounted in the plow mounting body 36 and piston rods 76 which is connected to the guide member 72 at their upper ends. Guide member 72 is provided with recesses 78 into which the connecting hooks 70 fit snuggly to firmly connect the ranging plow block 50 and the guide member 72. Guide member 72 is provided with a first set of wheels 80 and a second set of wheels 82. The first set of wheels 80 is arranged so as to travel along the sidewall 16 of the shield 12. The second set of wheels 82 is arranged so as to travel along the inside surface of face plates 20. In this manner, wheels 68, 80 and 82 provide a force transmission system wherein any lateral thrusts on the upper ranging plow block 50 are transmitted directly to the shield 12. Similarly, longitudinal forces exerted upon the upper ranging plow block 50 are transmitted through the power transmission rods 62 to the support member 34 and thus, to the frame 24.

Since the arch sections 14 are individually advanceable toward the mining wall M as the mining machine progresses, there is always a possibility that one of the arch sections 14 would be misaligned with respect to the remainder of the arch sections. To prevent damage to the mining machine if such a misaligned section is encountered, the upper guide member 72 is provided with boat-shaped or tapered terminal portions 84 at each end thereof. These terminal portions 84 are made sufficiently long so that the curved surfaces thereof will encounter any arch section which is not properly aligned before the plow face encounters such section. The tapered terminal portions 84 may then urge the misaligned section back into its proper position. Additionally, if desired, suitable controls may be added to automatically stop the mining machine before the plow can strike a greatly misaligned arch section.

The upper guide member 72 is also provided with a pair of dove-tail recesses 86 shaped to complement dove-tail portions 58 of support rods 56 so that the support rods 56 will not interfer with the guide members 72 when the lower ranging plow block 52 and the upper guide members 72 are in their retracted positions.

In order to provide a rigid inter-relationship between the frame 24 and the sidewall 16 of the shield 12, as well as to provide strong lateral support to the mining machine, a pair of guide assemblies 88 and 90 are provided. These guides include wheels 92 and 94 capable of rolling along the sidewall 16 while providing a rigid support to the mining apparatus. These guide assemblies are described more fully in application Ser. No. 509,489.

In order to rigidly support the lower ranging plow block 52 when in the fully lowered position, the support rods 56 include lower portions 96 which bear against the U-shaped channel 26, thus transmitting any lateral force to the frame 24 and to the guide assemblies 88 and 90.

As seen in FIG. 5, the plow mounting body 36 and the upper and lower ranging plow blocks 50 and 52 are also provided with a set of plow blades 98 and 100 which are hydraulically extensible.

Although the extension and retraction of the plow mounting body 36, the upper and lower ranging plow blocks 50 and 52, the upper guide member 72 and the plow blades 98 have been described as being hydraulically actuated, it is clear that other systems may be used for these movements. Thus, mechanical, electromechanical, electrical or pneumatic systems or combinations thereof may be used. However, for the invention as described, suitable hydraulic lines would be provided through appropriate control devices to selectively actuate the various expansion and retraction means at the appropriate times.

The means by which the mining apparatus is propelled along the mining shield 12 is preferably as described in application Ser. No. 549,823. Such a propulsion system has distinct advantages as set out in said application, however, other conventional drive systems may be used if desired.

The operation of the disclosed apparatus for mining will now be described.

Depending on the nature of the material in the mining face M, one or more of the extensible ripper blades 98 or 100 are extended by activating the appropriate hydraulic cylinders. As the entire hook plow assembly is driven along the length of the shield 12, on the conveyor rails 22, a cut is ripped off the face of the mine M. The size of the cut is of course determined by the number of blades extended. For harder materials, it may be necessary to make smaller cuts by using less of the blades extended, whereas in softer materials, a larger cut may be made on a single pass. On repeated passes, more of the blades 98 and 100 are extended, until all of the blades have been extended and have ripped the full length of the shield 12.

The blades are then retracted, and the entire plow mounting body 36 as well as the upper and lower ranging plow blocks 50 and 52 are moved forward into the cavity created by the ripper blades 98 and 100. The ripping operation is then repeated using the blades 98 and 100 as necessary to rip the remaining portion of the mine face M. This ripping operation is repeated until the plow apparatus is advanced fully to the limits of travel of the hydraulic cylinders 40.

To complete the full cut in front of the shield 12, the ranging plow blocks 50 and 52 with the conventional blades are raised and lowered respectively and incrementally to remove the remainder of the cut. Safety interlocks (not shown) may be provided to prevent the expansion of the ranging plow blocks vertically until the whole body has been fully advanced. When making the final cut before advancing the shield 12, the apparatus will be fully extended to the position as shown in FIGS. 1 and 3. The expansion is carried out by the various hydraulic cylinders 46, 48 and 74 as described previously. The mined material is allowed to fall onto conveyor belt 32 or is deposited thereon as described in application Ser. No. 509,489, and is carried out of the mine area. The ranging plow blocks 50 and 52 are then retracted to the position shown in FIG. 2, and the entire assembly is retracted within the shield. The shield may then be advanced, and the mining operation repeated.

While this invention has been described, it will be understood that it is capable of further modification, and this application is intended to cover any variations, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. A hook plow apparatus for use in longwall mining in conjunction with a mining shield having rails therein running along the length of the shield, said apparatus comprising:

a. a power transmission frame mounted for movement along said rails, b. a plow mounting body connected to said frame, c. upper and lower ranging plow blocks mounted on said plow mounting body, d. means for propelling said frame, said body, and said ranging plow blocks simultaneously along said rails, e. means for extending said mounting body and said ranging plow blocks toward the mine wall relative to said frame, and f. means for vertically extending said ranging plow blocks relative to said mounting body.

2. A hook plow apparatus as in claim 1 and including: power arms connecting said upper ranging plow block and said power transmission frame.

3. A hook plow apparatus as in claim 2 and wherein: said power arms are pivotally connected to said power transmission frame.

4. A hook plow apparatus as in claim 3 and wherein: said power arms are connected to said upper ranging plow block by a pin-in-slot connection.

5. A hook plow apparatus as in claim 1 and wherein: said means for vertically extending said ranging plow blocks comprises piston and cylinder means.

6. A hook plow apparatus as in claim 5 and including:
a. a first pair of hydraulic pistons for extending said upper ranging plow block, and
b. a second pair of hydraulic pistons for extending said lower ranging plow block.

7. A hook plow apparatus as in claim 6 and wherein: said first and second pairs of hydraulic pistons are independently operable.

8. A hook plow apparatus as in claim 1 and wherein: said lower ranging plow block is connected to said plow mounting body by a sliding dove-tail connection.

9. A hook plow apparatus as in claim 1 and wherein: said ranging plow blocks include extensible plow blades.

10. A hook plow apparatus as in claim 1 and wherein: said plow mounting body includes an upper guide member engageable with said shield and positionable between said shield and said upper ranging plow block for transmitting lateral forces from said upper ranging plow block to said shield.

11. A hook plow apparatus as in claim 10 and wherein:
said upper guide member is vertically extensible.

12. A hook plow apparatus as in claim 11 and wherein:
said upper guide member and said upper ranging plow block are interconnectable.

13. A hook plow apparatus as in claim 10 and wherein:
said plow mounting body includes extensible guide means engageable with said shield for transmitting lateral thrusts to said shield.

14. A hook plow apparatus as in claim 1 and wherein: said upper ranging plow block includes a guide roller for contact with a front face of said shield for transmitting lateral thrusts thereto.

15. A mining apparatus for longwall mining comprising:
a. a plurality of individually movable arch sections in side-by-side abutting relationship forming a tunnel like chamber having a bottom and a side wall and being open opposite said side wall toward the mining wall,
b. rail means positioned on said bottom,
c. a power transmission frame mounted for movement along said rails,
d. a plow mounting body connected to said frame,
e. upper and lower ranging plow blocks mounted on said plow mounting body,
f. means for propelling said frame, said body, and said ranging plow blocks simultaneously along said rails,
g. means for extending said mounting body and said ranging plow blocks toward the mine wall relative to said frame and said arch sections, and
h. means for vertically extending said ranging plow blocks relative to said mounting body.

16. A mining apparatus as in claim 15 and wherein: said plow mounting body includes an upper guide member engageable with said arch sections and positionable between said arch sections and said upper ranging plow block for transmitting lateral forces from said upper ranging plow block to said arch sections.

17. A mining apparatus as in claim 16 and wherein: said upper guide member includes a first set of wheels for rolling engagement along the surfaces of said arch sections forming said side wall.

18. A mining apparatus as in claim 17 and wherein:
a. the distal ends of said arch sections include depending face plates, and
b. said upper guide member includes a second set of wheels for rolling engagement along the inner surface of said face plates.

19. A mining apparatus as in claim 18 and wherein; said upper ranging plow block includes a set of rollers for rolling engagement along the outer surface of said face plates.

20. A mining apparatus as in claim 19 and including: means for rigidly interconnecting said upper guide member and said upper ranging plow block.

21. A mining apparatus as in claim 16 and wherein: said upper guide member includes tapered trailing and leading end portions, said end portions contacting any misaligned arch sections for urging said misaligned arch sections into alignment with the remainder of said arch sections as said power transmission frame travels along said rail means.

* * * * *